US010877426B2

(12) United States Patent
Rosenstein et al.

(10) Patent No.: US 10,877,426 B2
(45) Date of Patent: Dec. 29, 2020

(54) BINARY INK DEVELOPMENT UNIT SUPPORT STAND

(71) Applicant: HP INDIGO B.V., Amstelveen (NL)

(72) Inventors: Barak Rosenstein, Ness Ziona (IL); Tsahi Cohen, Ness Ziona (IL); Yehonatan Lugassy, Ness Ziona (IL); Itay Davidi, Kiryat-Gat (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/487,759

(22) PCT Filed: Mar. 14, 2017

(86) PCT No.: PCT/EP2017/056042
§ 371 (c)(1),
(2) Date: Aug. 21, 2019

(87) PCT Pub. No.: WO2018/166586
PCT Pub. Date: Sep. 20, 2018

(65) Prior Publication Data

US 2020/0233369 A1 Jul. 23, 2020

(51) Int. Cl.

| | |
|---|---|
| ***G03G 15/08*** | (2006.01) |
| ***G03G 21/16*** | (2006.01) |
| ***G03G 21/18*** | (2006.01) |

(52) U.S. Cl.
CPC ..... *G03G 21/1619* (2013.01); *G03G 15/0894* (2013.01); *G03G 15/0896* (2013.01); *G03G 21/181* (2013.01); *G03G 2215/00987* (2013.01); *G03G 2221/1876* (2013.01)

(58) Field of Classification Search
CPC ..... G03G 21/1619; G03G 15/0896; G03G 15/0894; G03G 21/181; G03G 2215/00987; G03G 2221/163; G03G 2221/1876; G03G 21/1676; G03G 2215/0875
USPC ..... 399/109
See application file for complete search history.

(56) References Cited

U.S. PATENT DOCUMENTS

| | | | |
|---|---|---|---|
| 4,760,424 | A | 7/1988 | Ohba et al. |
| 4,878,091 | A | 10/1989 | Morita et al. |
| 5,014,095 | A | 5/1991 | Yamada |
| 5,083,166 | A | 1/1992 | Hill et al. |
| 5,689,772 | A | 11/1997 | Fujiwara et al. |
| 8,909,098 | B2 | 12/2014 | Itabashi |
| 8,977,162 | B2 | 3/2015 | Kim et al. |
| 9,411,305 | B2 | 8/2016 | Gotoda |
| 9,442,423 | B2 | 9/2016 | Fukamachi |
| 9,513,577 | B2 | 12/2016 | Fukamachi et al. |
| 9,519,240 | B1 | 12/2016 | Ozawa |
| 9,529,298 | B2 | 12/2016 | Sato et al. |

(Continued)

FOREIGN PATENT DOCUMENTS

| | | | |
|---|---|---|---|
| EP | 0889375 | 1/1999 | |
| EP | 0679959 B1 | 3/2009 | |
| WO | WO-2018186871 A1 * | 10/2018 | ..... G03G 21/0088 |

*Primary Examiner* — Walter L Lindsay, Jr.
*Assistant Examiner* — Laura Roth
(74) *Attorney, Agent, or Firm* — Dierker & Kavanaugh PC

(57) ABSTRACT

An example stand for the support of a Binary Ink Development unit has first and second spaced supports upstanding from a base portion to securely receive a Binary Ink Development unit and also to securely receive a component of a Binary Ink Development unit.

6 Claims, 5 Drawing Sheets

(56) References Cited

U.S. PATENT DOCUMENTS

| | | | | |
|---|---|---|---|---|
| 2003/0170045 | A1* | 9/2003 | Lewis | G03G 15/0894 399/109 |
| 2005/0069341 | A1* | 3/2005 | Mori | G03G 15/0894 399/109 |
| 2005/0281580 | A1* | 12/2005 | Lewis | G03G 15/086 399/109 |
| 2006/0133847 | A1* | 6/2006 | Burton | G03G 15/0894 399/106 |
| 2010/0019443 | A1 | 1/2010 | Ichikawa | |
| 2010/0212137 | A1* | 8/2010 | Holmes | G03G 15/0894 29/428 |
| 2013/0223888 | A1* | 8/2013 | Tanner | G03G 15/10 399/239 |
| 2013/0322945 | A1 | 12/2013 | Nishimura | |
| 2014/0356023 | A1* | 12/2014 | Sakurada | G03G 15/0893 399/109 |
| 2015/0139685 | A1 | 5/2015 | Hoshino et al. | |
| 2016/0004189 | A1* | 1/2016 | Massaro, Jr. | G03G 15/0894 399/109 |

* cited by examiner

BINARY INK DEVELOPMENT UNIT SUPPORT STAND

BACKGROUND

Binary Ink Development (BID) units are involved in the supply and transfer of ink within the printing engine of a digital printing press and the manner in which they can be deployed, maintained and/or replaced has an impact on cost and operational efficiencies of the printing press and related printing process.

BRIEF INTRODUCTION OF THE DRAWINGS

Examples of the disclosure for a more complete understanding are further described hereinafter with reference to the accompanying drawings, in which.

DETAILED DESCRIPTION

Examples of the disclosure can provide support stands for ink-handling devices such as for example BID units, and component parts of such devices, so as to assist with the handling and manipulation of such BID units, and their component parts. Such manipulation can occur as part of a procedure for mounting a BID unit within a printing engine of a digital printing press, or for the removal of a BID unit from a printing engine of a digital printing press, or for the handling of a BID unit and its component parts during, for example, a maintenance or cleaning operation to assist with maintenance or for replacement of the component part within the BID unit and/or maintenance or replacement of the BID unit within the printing engine, or otherwise.

The BID unit, and its component part, can then be supported in a manner serving to ease their handling and also possibly reduce the likelihood of damage during, for example, removal, maintenance and/or replacement of the BID unit and/or its replacement parts.

An example of the disclosure may be configured for the support of two BID units. Further examples may be configured also for the support of two component elements of the BID unit. Examples of component parts can comprise Developer Rollers. Examples of the disclosure can support BID units in positions on the stand next to each other. Examples of the disclosure can support the component parts in positions on the stand next to each other.

An Example of the support stand can include upstanding walls having engagement formation for receiving the BID units. Examples of the disclosure can also include upstanding walls having engagement formation for receiving the component parts. Examples of the engagement formations can comprise slots in the walls. As one example, common upstanding walls are provided for the support of the BID units and the component parts. Examples of the walls can include slots in the top edge of the walls for support of the BID units. Examples of the walls can include a slot in front edges of the walls for support of a component part. In further examples of the disclosure the spaced supports upstanding from the base can be provided at respective opposite edges of the base.

Examples of a support stand of the disclosure can also include scale markers to indicate which of the BID support unit or component part might be responsible for print defects. An example can have scale markers at edge regions of the base. An example may provide for a first set of scale markers, and a second set of scale markers, with the pitch of the first and second sets being different. The pitch may be determined by the potential characteristics of a print defect arising from the BID unit, as compared with a print defect arising from the component part.

Figure 1:
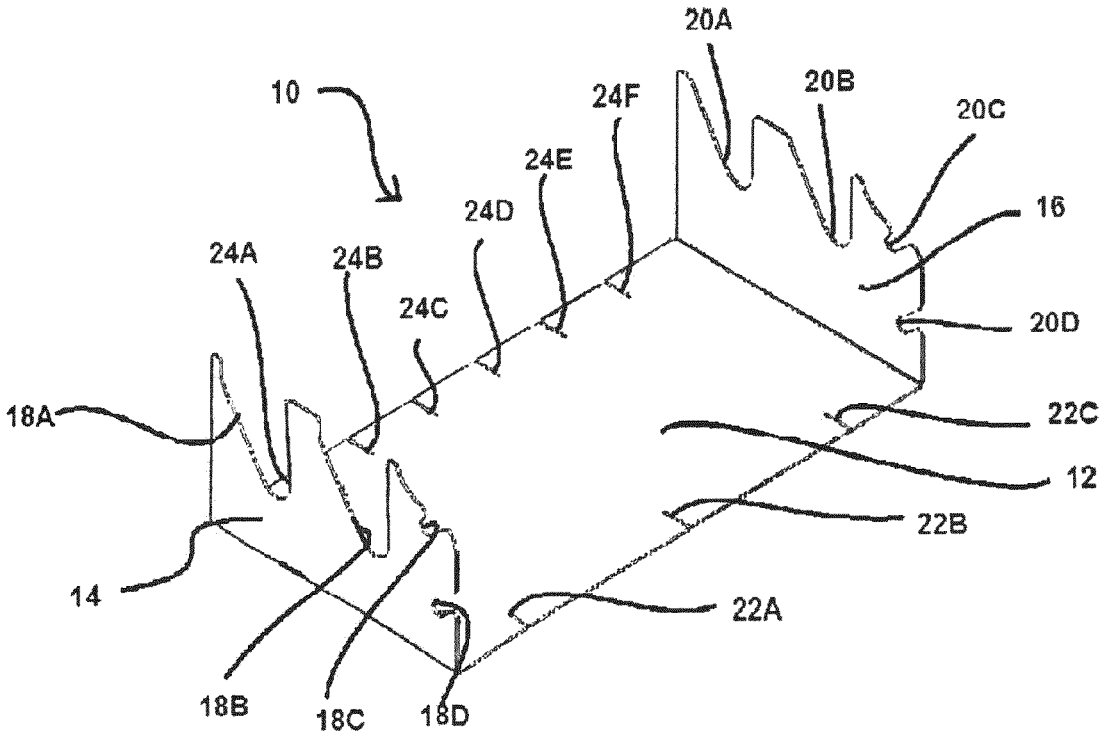
FIG. 1 shows a perspective view of a BID support stand.

FIG. 1 shows a perspective view of a BID support stand 10 according to an example of the disclosure and which comprises a rectangular base 12 and two side walls 14, 16 extending upwardly, in a substantially orthogonal manner, from opposite side regions of the base 12.

Examples of a BID support stand 10 such as that illustrated can be formed of any appropriate material, and in any appropriate manner. In one example, the support stand is formed from a single sheet metal piece bent at two locations to form the base 12 and the upstanding support walls 14, 16.

In the illustrated example, each of the upstanding support walls 14, 16 is provided with four slots 18A, 18B, 18C and 18D and 20A, 20B, 20C and 20D. The slots 18A-18D in one 14 of the walls are aligned with the slots 20A-20D in the other wall 16 to form aligned pairs 18A, 20A; 18B, 20B; 18C, 20C; 18D, 20D. The aligned pairs of slots receive the BID units and component parts in the stand.

In the illustrated example, slots 18A and 20A are aligned for support in suspended manner of a BID unit extending there-between. Slots 18B and 20B are also aligned for support in suspended manner of a BID unit there-between. Also the slots 18C and 20C can be aligned for the support of a BID unit component part there-between. Slots 18D and 20D are aligned for support of a BID unit component part there-between.

In the illustrated example of the disclosure, the front and back edges of the base 12 each include a series of scale indicators 22A, 22B and 22C; and 24A, 24B, 24C, 24D, 24E and 24F. The scale indicators can be provided and formed in any manner appropriate for example by marking or incision. The scale markers can comprise slits formed in the respective front and back edges of the base 12. Examples of the size and shape of slots as provided in an upstanding support wall are illustrated in FIG. 2 which is a side elevational view of the BID support stand 10 from beyond the side wall 16 of FIG. 1.

Figure 2:
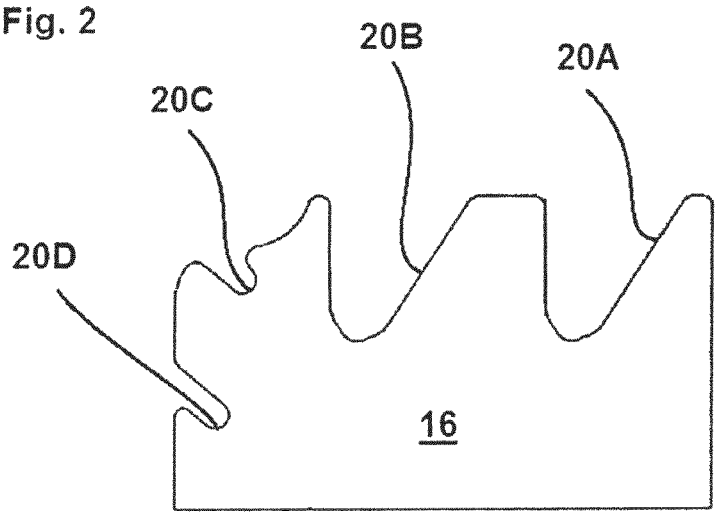
FIG. 2 illustrates a side elevational view of the BID support stand of FIG. 1.

FIG. 2 shows examples of different dimensions of slots 20A, 20B for receiving a BID unit, as compared with slots 20C, 20D for receiving components of the BID unit. The slots 20A, 20B for receiving the BID units can be adjacent to each other and formed in the upper edge of the upstanding wall 16. Also, the slots for receiving BID unit component parts can be adjacent each other. One 20D of the slots for the component can be formed in a front edge surface of the upstanding wall 16.

Figure 3:
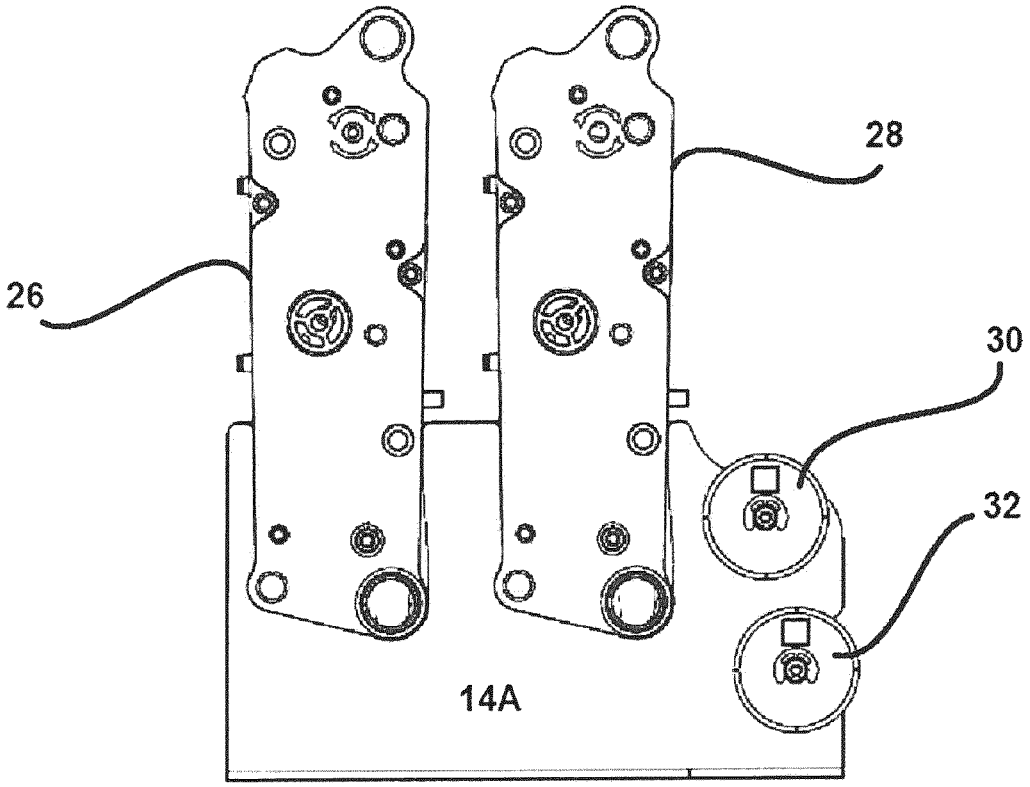
FIG. 3 is a side elevational view of the support stand of FIG. 1 and with BID units and component parts mounted thereon.

An example illustrating a BID support stand loaded with BID units and component parts is illustrated in FIG. 3. In this illustrated example, two BID units 26, 28 are securely mounted on the support stand 10 through receipt in the respective aligned slots 18A, 20A, and 18B, 20B of the respective upstanding support walls 14, 16. Also in this example, the BID unit component parts comprise Developer Rollers 30, 32 which are also securely mounted between the upstanding support walls 14, 16 within the respective aligned slot pairs 18C, 20C and 18D, 20D.

Also the support stand 10 can be arranged to support a Developer Roller having been removed from one of the supported BID units, or a Developer Roller about to be introduced into one of the supported BID units. The separation of a Developer Roller from a BID unit, and the separate mounting of the Developer Roller and BID unit on a support stand such as that illustrated allow for ready maintenance of each unit and/or roller in a manner limiting potential damage thereto and enhancing the lifetime of the BID unit and/or Developer Roller, and thereby the printing engine.

Figure 4:
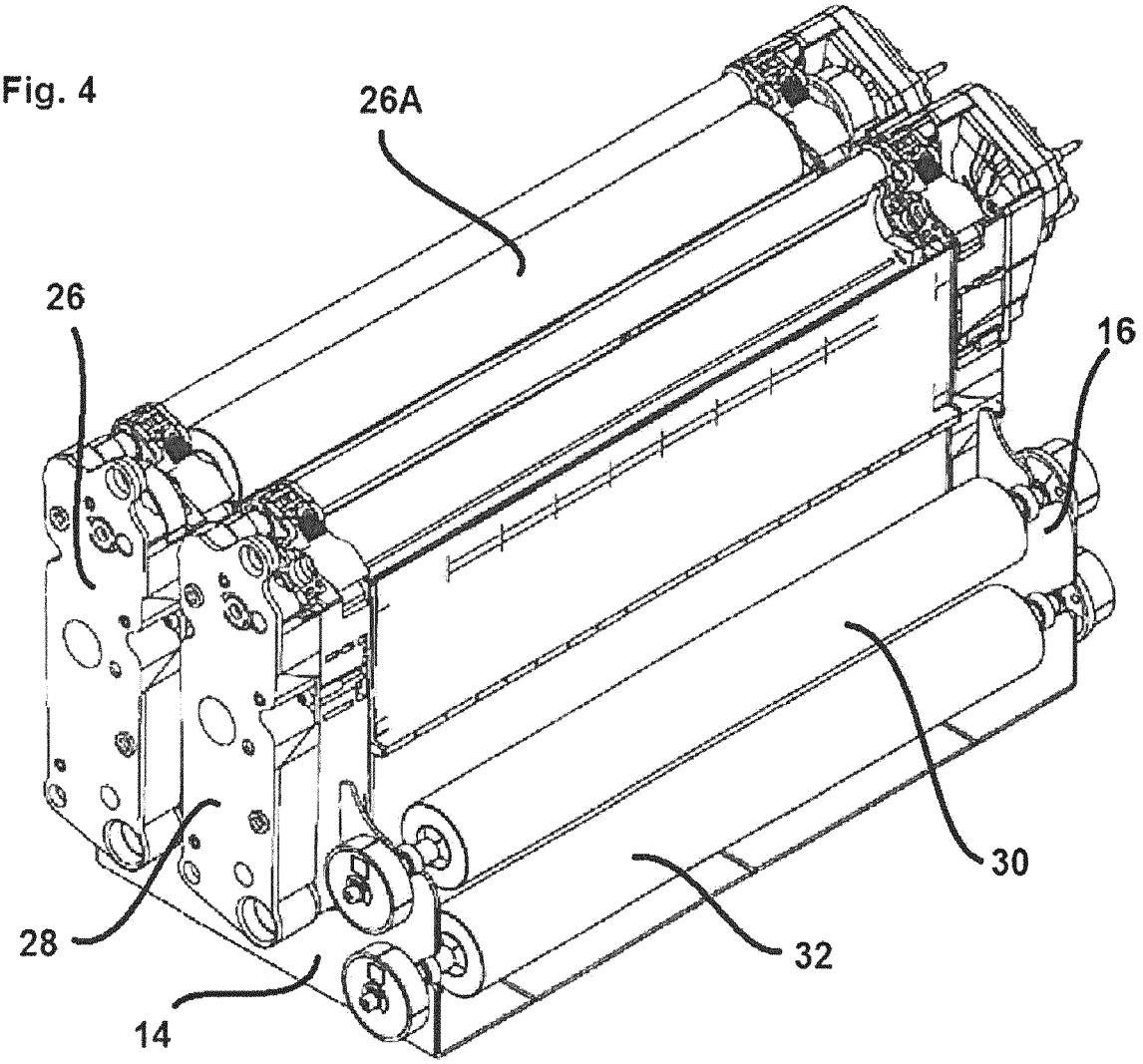
FIG. 4 is a perspective view of the BID support stand of FIG. 1 and with BID units and component parts mounted thereon.

An example of the present disclosure is further illustrated by way of FIG. 4 which comprises a perspective view of the support and mounting arrangement illustrated in FIG. 3. The BID unit 26 is illustrated with a Developer Roller 26A mounted therein, whereas the BID unit 28 is illustrated in a manner having had its Developer Roller removed therefrom, for example for replacement or repair.

In the example of FIG. 4, either of the Developer Rollers 30, 32 can be loaded into the BID unit 28. The Developer Rollers could comprise new replacement components, or current components that have been subjected to a maintenance or cleaning procedure.

Examples of the present disclosure provide a support stand allowing for the secure removal and support of a Developer Roller from a BID unit in a manner allowing for ease of maintenance, replacement and/or repair of either or both of the BID unit and Developer Roller for ongoing operation of a printing engine within a digital printing press.

Figure 5:
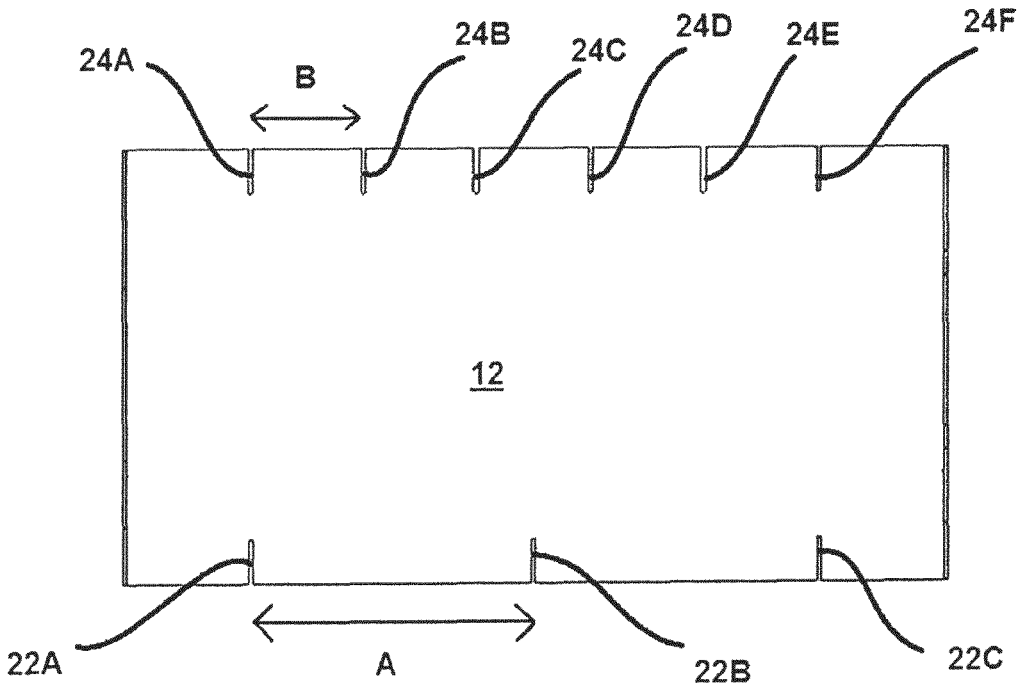
FIG. 5 is a plan view of the base portion of the BID support stand of FIG. 1.

FIG. 5 illustrates an example of a base portion 12 of a BID support stand of the disclosure and wherein series of spaced scale markers 22A-22C; 24A-24F are provided along the front and rear edges of the base 12. A front edge of the base 12 comprises three markers 22A, 22B and 22C separated at a pitch indicated by arrow A. A rear edge of the base plate 12 is provided with a series of scale markers 24A, 24B, 24C, 24D, 24E and 24F which are separated by a pitch indicated by arrow B. As will be seen the pitch B is less than pitch A. The respective pitches A and B are determined to indicate different potential sources for print defects appearing in the eventual printed media (not shown in the drawings).

Examples of scale markers of the disclosure can include respective pitches that are determined to be associated with respective elements to be supported by the support stand.

In the illustration of FIG. 5 therefore, one of the series of scale markers 24A-24F is associated with a BID support, and the other of the series of scale markers 22A-22C is associated with a Developer Roller. This association is such that, though comparison with print defects appearing on printed media, the scale markers can identify which of the separately supported elements mounted on the BID support stand is most likely to be responsible for the print defects. The particular element, for example, BID unit or Developer Roller identified as the likely source of the print defect can then be further inspected for a maintenance operation, for example a cleaning operation, in an attempt to correct the printing defect or for replacement.

The scale markers of the proposal can be spaced in a manner determined by the anticipated spacing of print defects of which in turn can be determined by operational characteristics of a component of a BID unit.

In the illustrated example, the pitch B of the scale markers 24A-24F can be 53 mm +/−2% as this is consistent with the spacing of print defects that can arise from, for example, the cleaning roller or squeegee roller of a BID unit. The pitch A of the scale markers 22A-22C can be 131 mm +/−2% as this is consistent with the spacing of print defects that can arise from the Developer Roller.

In examples of the disclosure, a stand can be provided for a BID unit that has prepared a thin dense film of a marking agent, for example electrically charged Electroink, on its Developer Roller surface. During printing, the Developer Roller can engage with other ink-transfer consumables, for example the PIP drum, and electrical fields there-between attract the ink so as to develop an image on the PIP surface. This can involve frequent and sustained ink transfers between the BID unit and other ink-transfer consumables.

Examples of the disclosure can provide a support stand for BID units that can serve as a secure platform for installation of a Developer Roller into a BID unit, and then for installation of the BID unit into a printing press. Examples of the stand can also provide a secure platform for removal and handling of BID units during maintenance procedures. Examples of the disclosure can assist with removal of the Developer Roller from the BID unit, its secure support hooked on the slots of the stand. The Developer Roller can then for example be cleaned by ink removal and in a manner offering stable support for the Developer Roller to reduce the potential for mechanical damage during the cleaning procedure. The BID unit can also be cleaned in a stable manner for example by the removal of sludge and ink particles.

The invention claimed is:

1. A freestanding support, comprising:

a base;

parallel first and second sidewalls extending up from the base opposite one another a distance corresponding to a length of a Binary Ink Developer unit;

opposing first slots along a first edge of each sidewall, the first slots being configured to receive and suspend a Binary Ink Developer unit between the sidewalls; and opposing second slots along a second edge of each sidewall, the second slots being smaller than the first slots and configured to receive and suspend a developer roller between the sidewalls.

2. The support of claim 1, wherein the second edge is below the first edge.

3. The support of claim 1, wherein:

the opposing first slots comprise two sets of opposing first slots along the first edge of each sidewall, each set of first slots being configured to receive and suspend a Binary Ink Developer unit between the sidewalls such that the support can support two Binary Ink Development units at the same time; and the opposing second slots comprise two sets of opposing second slots along the second edge of each sidewall below the first edge, each set of second slots being configured to receive and suspend a developer roller such that the support can support two developer rollers at the same time.

4. A freestanding support, comprising:

a base;

parallel first and second sidewalls extending up from the base opposite one another a distance corresponding to a length of a Binary Ink Developer unit;

opposing first slots along a first edge of each sidewall, the first slots being configured to receive and suspend a Binary Ink Developer unit between the sidewalls; and scale markers along the base for comparison with print defects appearing in printed media.

5. The support of claim 4, comprising opposing second slots along a second edge of each sidewall, the second slots being smaller than the first slots and configured to receive and suspend a developer roller between the sidewalls.

6. The support of claim 4, wherein the scale markers comprise first scale markers along a first side of the base and second scale markers along a second side of the base opposite the first side.

* * * * *